US010837240B2

(12) United States Patent
Derkacz et al.

(10) Patent No.: US 10,837,240 B2
(45) Date of Patent: Nov. 17, 2020

(54) SEAL AND SACRIFICIAL COMPONENTS FOR A DRILL STRING

(71) Applicant: Evolution Engineering Inc., Calgary (CA)

(72) Inventors: Patrick Robert Derkacz, Calgary (CA); Justin Christopher Logan, Calgary (CA); Aaron William Logan, Calgary (CA); Angelica J. B. Francoeur, Calgary (CA); Jason B. Wackett, Calgary (CA); Danick R. J. Normandeau, Calgary (CA); Riley J. Berry, Calgary (CA)

(73) Assignee: Evolution Engineering Inc., Calgary (CA)

( * ) Notice: Subject to any disclaimer, the term of this patent is extended or adjusted under 35 U.S.C. 154(b) by 84 days.

(21) Appl. No.: 16/074,380

(22) PCT Filed: Dec. 11, 2017

(86) PCT No.: PCT/CA2017/051491
§ 371 (c)(1),
(2) Date: Jul. 31, 2018

(87) PCT Pub. No.: WO2018/102932
PCT Pub. Date: Jun. 14, 2018

(65) Prior Publication Data

US 2019/0100969 A1 Apr. 4, 2019

Related U.S. Application Data

(60) Provisional application No. 62/431,969, filed on Dec. 9, 2016.

(51) Int. Cl.
*E21B 17/04* (2006.01)
*E21B 17/02* (2006.01)
(Continued)

(52) U.S. Cl.
CPC ..... *E21B 17/028* (2013.01); *E21B 17/003* (2013.01); *E21B 17/04* (2013.01); *E21B 47/13* (2020.05); *E21B 47/18* (2013.01)

(58) Field of Classification Search
CPC ..... E21B 17/028; E21B 17/003
See application file for complete search history.

(56) References Cited

U.S. PATENT DOCUMENTS 2,650,067 A * 8/1953 Martin ..... E21B 17/003 175/50
3,818,996 A 6/1974 McCaleb
(Continued)

FOREIGN PATENT DOCUMENTS

WO WO2014075190 A1 5/2014

OTHER PUBLICATIONS

ISA/CA, International Search Report and Written Opinion for PCT Patent Application No. PCT/CA2017/051491, dated Mar. 15, 2018.
(Continued)

*Primary Examiner* — Cathleen R Hutchins
(74) *Attorney, Agent, or Firm* — NK Patent Law

(57) ABSTRACT

A gap joint for use with a gap sub for electromagnetic telemetry. The gap joint has a replaceable uphole shoulder on the male gap joint component, which may be composed of a sacrificial material, to extend gap joint useful life where there is electrolysis of the component outside diameter. The gap joint also has a thicker outside diameter seal to reduce the risk of underlying O-ring extrusion and failure, again extending gap joint useful life. The thicker seal may also be able to withstand higher pressures before collapsing or experiencing punctures in unsupported areas. The replaceable shoulder and outside diameter seal can be used separately or together in a gap joint.

16 Claims, 9 Drawing Sheets

(51) Int. Cl.

| | |
|---|---|
| ***E21B 17/00*** | (2006.01) |
| ***E21B 47/13*** | (2012.01) |
| ***E21B 47/18*** | (2012.01) |

(56) References Cited

U.S. PATENT DOCUMENTS

| | | | | |
|---|---|---|---|---|
| 4,496,174 | A * | 1/1985 | McDonald | E21B 47/122 285/53 |
| 6,098,727 | A * | 8/2000 | Ringgenberg | E21B 17/028 175/325.2 |
| 7,252,160 | B2 | 8/2007 | Dopf et al. | |
| 7,605,716 | B2 | 10/2009 | Peter et al. | |
| 2005/0068703 | A1* | 3/2005 | Dopf | E21B 17/003 361/66 |
| 2010/0025111 | A1 | 2/2010 | Gearhart et al. | |
| 2012/0031669 | A1 | 2/2012 | Foster | |
| 2013/0161096 | A1 | 6/2013 | Benson et al. | |
| 2015/0330155 | A1* | 11/2015 | Logan | F16L 15/08 166/380 |

OTHER PUBLICATIONS

USPTO, Non-Final Office Action for corresponding U.S. Appl. No. 16/052,124, dated Jan. 13, 2020, 12 pages.

USPTO, Final Office Action for corresponding U.S. Appl. No. 16/052,124, dated Aug. 13, 2020.

* cited by examiner

SEAL AND SACRIFICIAL COMPONENTS FOR A DRILL STRING

RELATED APPLICATIONS AND PRIORITY

This application is a U.S. National Stage application of International Application No. PCT/CA2017/051491, filed Dec. 11, 2017, which claims priority to U.S. Provisional Application Ser. No. 62/431,969, filed Dec. 9, 2016, the contents being explicitly incorporated herein by reference in their entirety.

FIELD OF THE INVENTION

The present invention relates to gap joints within electromagnetic telemetry subs used in downhole drilling. More particularly, gap joints comprising a replaceable part and/or wear indicator.

BACKGROUND OF THE INVENTION

Recovering hydrocarbons from subterranean zones relies on the process of drilling wellbores. Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid usually in the form of a drilling "mud" is typically pumped through the drill string. The drilling fluid cools and lubricates the drill bit and carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit a BHA may comprise elements such as: apparatus for steering the direction of the drilling (e.g., a steerable downhole mud motor or rotary steerable system); sensors for measuring properties of the surrounding geological formations (e.g., sensors for use in well logging); sensors for measuring downhole conditions as drilling progresses; systems for telemetry of data to the surface; stabilizers; and heavy weight drill collars, pulsers and the like. The BHA is typically advanced into the wellbore by a string of metallic tubulars (drill pipe).

Telemetry information can be invaluable for efficient drilling operations. For example, a drill rig crew may use the telemetry information to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain real-time data allows for relatively more economical and more efficient drilling operations. Various techniques have been used to transmit information from a location in a bore hole to the surface. These include transmitting information by generating vibrations in fluid in the bore hole (e.g. acoustic telemetry or mud pulse telemetry) and transmitting information by way of electromagnetic signals that propagate at least in part through the earth (electromagnetic or "EM" telemetry).

Other telemetry systems use hardwired drill pipe or fibre optic cable to carry data to the surface.

A typical arrangement for electromagnetic telemetry uses parts of the drill string as an antenna. The drill string may be divided into two conductive sections by including an insulating joint or connector (a "gap sub") in the drill string. The gap sub is typically placed within a BHA such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. The electromagnetic signals may be detected at the surface, for example by measuring electrical potential differences between the drill string and one or more ground rods.

In some EM telemetry systems, the telemetry probe is provided with a gap joint, an assembly that serves as an insulating joint to ensure that the probe does not create a conductive path across the gap sub.

SUMMARY OF THE INVENTION

The present invention, among other aspects, provides improved gap joint designs as disclosed herein.

According to one broad aspect as described herein, there is provided a gap joint comprising a replaceable uphole or downhole shoulder. The shoulder may be located at the first point of conductive materials, as this may be the point at which electrolysis may first be exhibited. The uphole shoulder may be a ring-shaped component that seats on the uphole end of the male gap joint component. The downhole shoulder may also be a ring-shaped component that seats on the downhole end of the female gap joint component. The shoulder may be composed of a material that readily loses electrons and thus functions as a sacrificial anode or a wear type indicator.

According to another broad aspect as described herein, there is provided an outside diameter seal to overlie inner O-rings and seat within a circumferential recess in the gap joint exterior. The outside diameter seal may be thicker than conventional seals, and it may comprise at least one shoulder to abut an inner surface of the recess and thus improve the sealing functionality. The outside diameter seal may be composed of polyether ether ketone (PEEK).

According to another broad aspect as described herein, there is provided a wear type indicator configured to be placed at various points along the drill string. The wear type indicator may exhibit wear prior to damage occurring to the drill string thereby permitting maintenance and/or preventative measures to be conducted on the drill string prior to actual damage occurring.

A detailed description of exemplary aspects of the present invention is given in the following. It is to be understood, however, that the invention is not to be construed as being limited to these aspects. The exemplary aspects are directed to applications of the present invention, while it will be clear to those skilled in the art that the present invention has applicability beyond the exemplary aspects set forth herein.

BRIEF DESCRIPTION OF THE DRAWINGS

In the accompanying drawings, which illustrate exemplary embodiments of the present invention.

Exemplary aspects of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description of aspects of the technology is not intended to be exhaustive or to limit the invention to the precise forms of any exemplary aspect. Accordingly, the description and drawings are to be regarded in an illustrative, rather than a restrictive, sense.

Figure 1A:
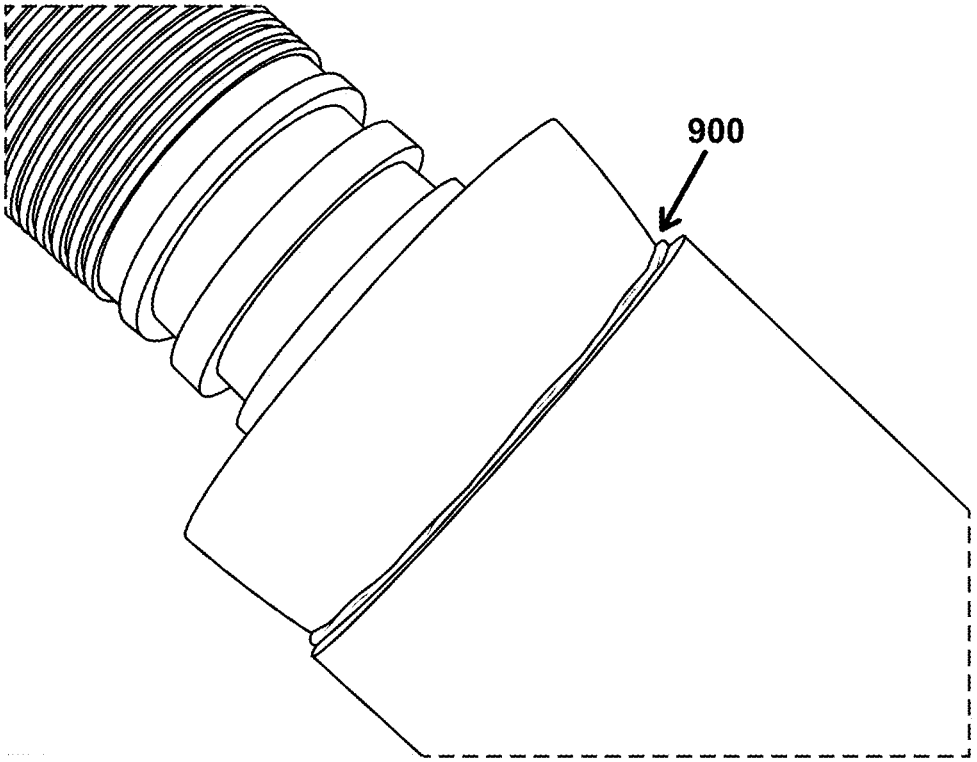
FIG. 1*a* is a photographic image of a gap joint with evidence of electrolysis.

Through use gap joints, among other components, may suffer deleterious effects during operation. For example, electromagnetic current transmission may result in electrolysis (and electron loss) at the outside diameter of the gap joint, at the leading edge of the gap. This electrolysis may break down the outer surface of the gap joint into solution. This type of degradation may occur at joints, at ends, the gap joints, a landing spider, and/or parts of a pulser. In particular, the degradation may occur on the metal components of the drill string. This degradation may have the effect of reducing the useful life of the gap joint and/or the other components. The degradation may be caused by a large downhole power source and may create an environment capable of electrolysis. The electrolysis may be localized to areas where metal is exposed and/or at locations where two different metals may meet on the drill string. FIG. 1*a* is a photograph of a gap joint uphole end that is experiencing electrolysis 900.

Figure 1B:
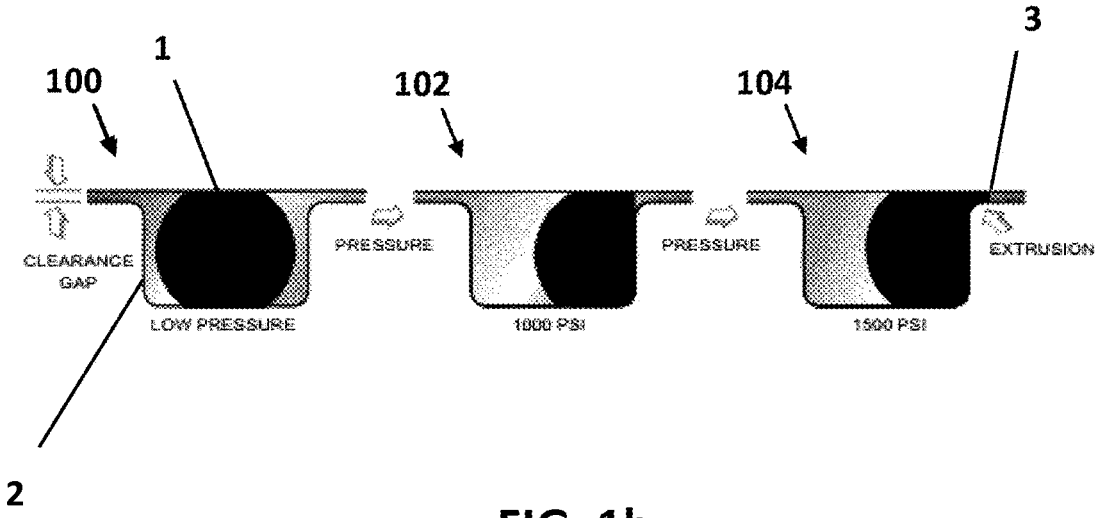
FIG. 1*b* is an illustration of how O-ring extrusion can occur.

In another example, where outer seals overlie inner O-ring seals, those outer seals may deform due to hoop stresses from hydrostatic head and pump pressure. As the outer seal deforms and presses against and across the O-ring surface, the O-ring shears, extruding into any clearance gap and potentially failing entirely. As can be seen in FIG. 1*b*, an O-ring 1 is seated in a gland 2. A left-hand image 100 shows the O-ring 1 properly sealing the gland 2. As pressure increases in the central image 102, the O-ring 1 is pressed against a side of the gland 2, and a right-hand image 104 shows an ultimate deformation due to shear as the O-ring 1 is extruded into a clearance gap 3. Such deformation causes damage to the O-ring 1 and over time may result in complete failure of the O-ring 1. Structural modifications may counter such deleterious effects as further described herein.

Figure 2A:
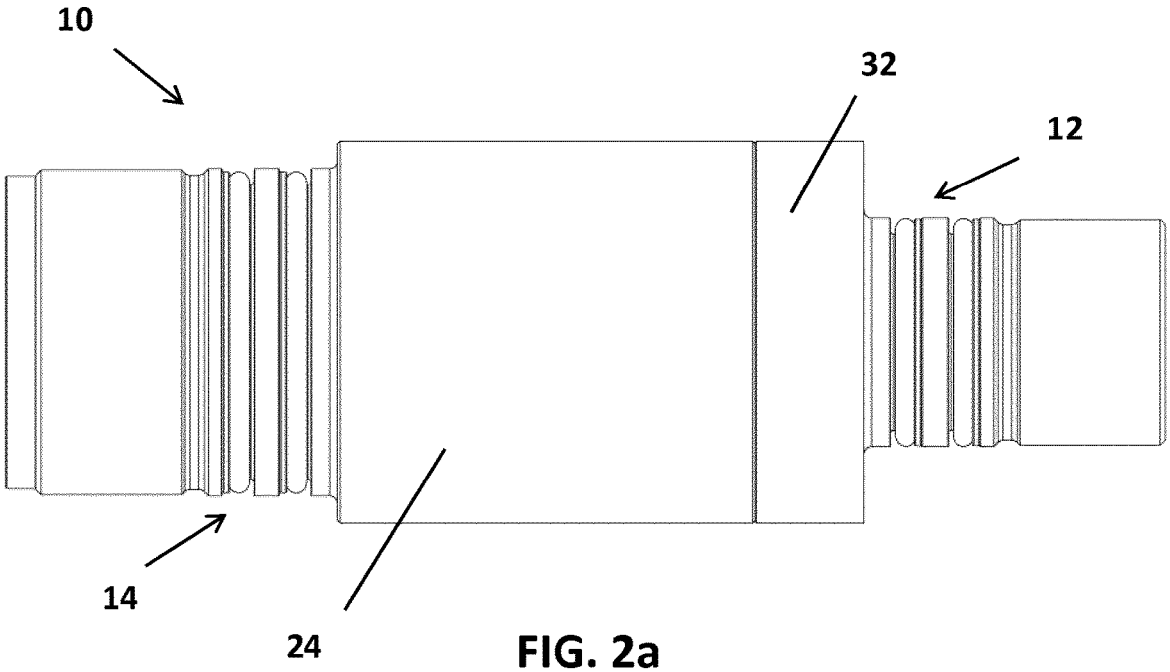
FIG. 2*a* is a side elevation view of a gap joint without a replaceable shoulder or enhanced outside diameter seal.
Figure 2B:
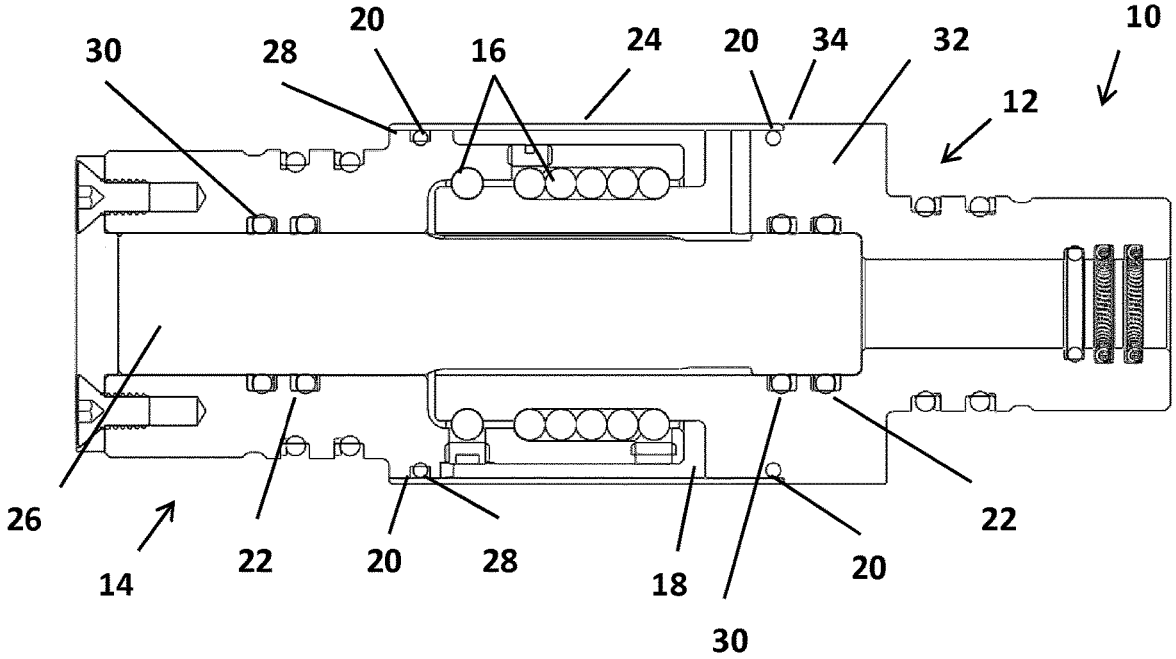
FIG. 2*b* is a side cross-sectional view of the gap joint of FIG. 2*a;*

According to one aspect, FIGS. 2*a* and 2*b* illustrate a gap joint 10 that may comprise a one-piece male gap joint component 12 and a thin outside diameter seal 24 overlying O-rings 20.

The gap joint 10 may comprise a male gap joint component 12 received partially within a female gap joint component 14. At an interface of the gap joint components 12, 14, a series of channels filled with electrically isolating balls 16 (which may alternatively be other geometric shapes such as rods or cylinders) and a plastic 18 (e.g. thermoplastic) that may be injected after insertion of the balls 16. The O-rings 22 may be inserted into glands 30 on an inner surface of the components 12, 14, and an inside diameter seal 26 may be inserted to cover the inner surface of the female gap joint component 14 and part of the inner surface of the male gap joint component 12. The inside diameter seal 26 may also be used as an axial spacer to retain the male and female components 12, 14 at a spacing desirable for electromagnetic (EM) efficiency during EM telemetry to enable ball 16 insertion and plastic 18 injection. Glands 28 may be provided on an outer surface of the components 12, 14, to receive the O-rings 20, and the outside diameter seal 24 may be received over top of the O-rings 20. The male gap joint component 12 may comprise an uphole shoulder section 32 which has a downhole edge 34, and the outside diameter seal 24 may abut this downhole edge 34.

The design of FIGS. 2*a* and 2*b* may provide suitable sealing in some operational environments, such as oil-based drilling fluids that may have inherent low conductive properties. In such environments, if fluid ingress occurs, the oil-based fluid may not cause loss in electromagnetic (EM) efficiencies. Nevertheless, the outer sealing may fail under certain conditions and in an environment with a conductive fluid, such as in a brine-based drilling fluid, may cause a significant loss to EM efficiencies. The outside diameter seal 24 may deform in the downhole environment due to hoop stresses from hydrostatic head and pump pressure. As the seal 24 deforms and presses against and/or across the O-ring 20 surfaces (and/or deforms into the O-ring gland 28, allowing a leak path), the O-rings 20 may shear and/or extrude into any clearance gap between the seal 24 and the components 12, 14, potentially causing seal failure. A failure of the seals may in turn allow ingress of fluids and/or negative impact on the functionality of the gap joint 10. In addition, a thin seal may be easily punctured by fluid pressure if the seal is not fully supported, and thus bypass the O-rings 20 entirely.

Further, electrolysis may occur at the outside diameter of the gap joint 10, in this aspect, at the interface of the shoulder 32 and the outside diameter seal 24. This electrolysis may have the effect of reducing the useful life of the gap joint, and may require a complete replacement of the gap joint 10, which may be complex and uneconomical to address the damage from the electrolysis. In other aspects, electrolysis may occur on the female gap joint component 14 as described with reference to FIGS. 4*a* and 4*b* below.

Figure 3A:
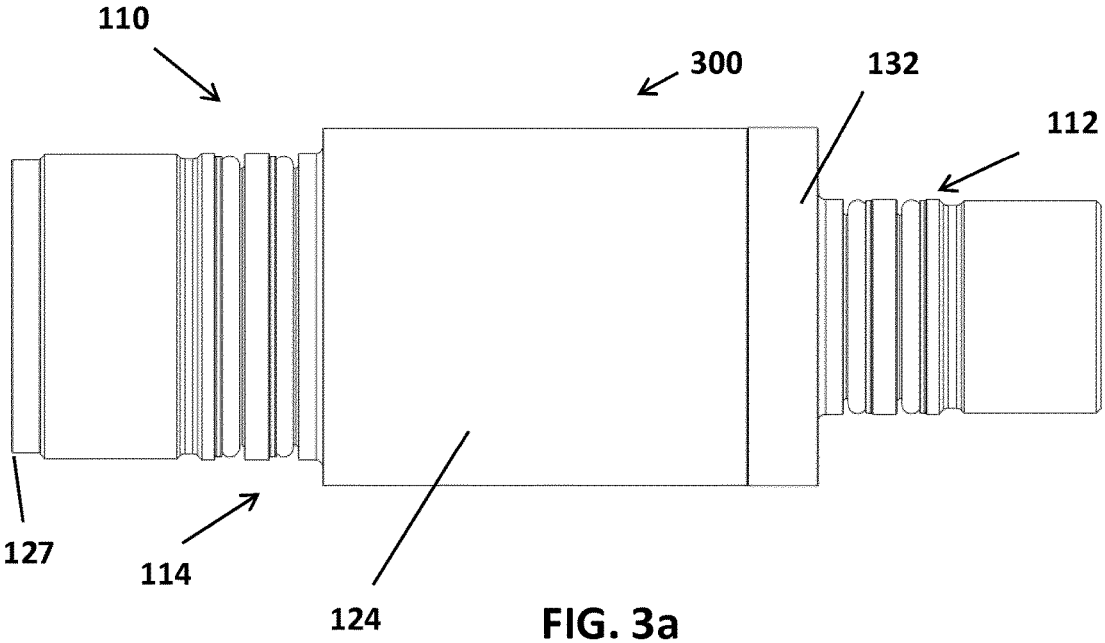
FIG. 3*a* is a side elevation view of a gap joint with both a replaceable shoulder and an enhanced outside diameter seal.
Figure 3B:
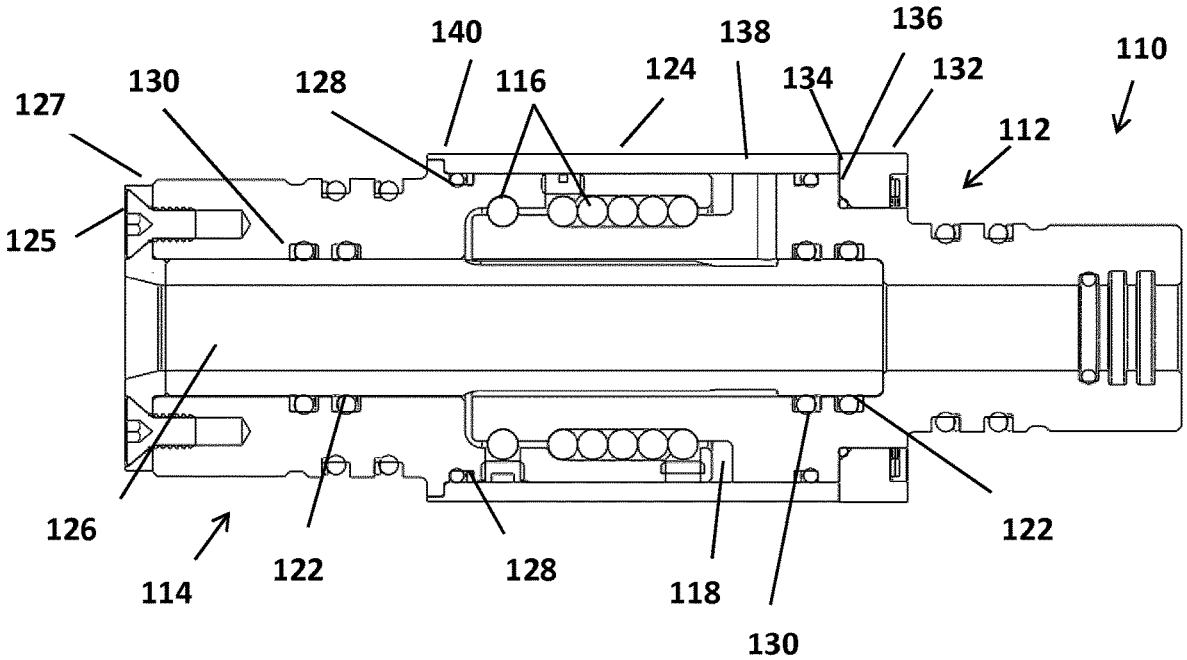
FIG. 3*b* is a side cross-sectional view of the gap joint of FIG. 3*a;*

Turning now to FIGS. 3*a* and 3*b*, a gap joint design 300 is illustrated having a replaceable shoulder 132 located proximate to a male gap joint component 112. The gap joint 110 may comprise the male gap joint component 112 matingly received in a female gap joint component 114, such as on a landing spider or a pulser. Electrical isolation of the male and female components 112, 114, and structural support for mechanical loading (e.g. axial forces and/or torsional forces loading), may be achieved in part by electrically isolating balls 116 received within channels, separating the components 112, 114, and an insulative plastic 118 which may be injected into the spaces between the components 112, 114. The strength of the gap joint 110 may be enhanced by the balls 116 and channel arrangement, while the insulating plastic injection 118 may fill the void space to reduce any fluid conductive paths. The ball fill port plugs (not shown) may be solid, which may reduce air and/or injected plastic re-circulation during the injection process, thus resulting in less voids and more consistent and uniform plastic properties.

The inner surfaces of the components 112, 114 may be provided with glands 130 for receipt of O-rings 122. Once the O-rings 122 are seated in the glands 130, an inside diameter seal 126 may be inserted, covering the O-rings 122, all the inner surface of the female gap joint component 114 and part of the male gap joint component 112. In this aspect, although not shown in the FIGS. 3*a* and 3*b*, the seal 126 may have a hexagonal external surface where it may be in contact with the injected plastic 118. The seal 126 may have a circular inner surface. The flat surfaces of the hexagonal external surface may help prevent rotation of the seal 126 during service life and operation of the gap joint 110 and/or during disassembly of the gap joint 110 from the mating component for servicing, thus extending an effective life of the seal 126. A plurality of screws 125, in this aspect four screws 125 (two of which are shown in sectional view FIG. 3*b*), secure a downhole plate 127 in place against the downhole end of the female gap joint component 114. The downhole plate 127 and screws 125 may help to retain the inside diameter sleeve 126 in position and deter axial movement of the seal 126 caused by pressure variations. This retention may enhance the effective life of the O-rings 122. The ability to remove the screws 125 may also allow for conversion to a dual grounding arrangement, where the screws 125 may be removed and the plate 127 may be replaced with a metal version with a canted coil spring and a gland at the downhole end of the gap joint 110.

The outer surfaces of the gap joint components 112, 114 may be provided with glands 128 for receipt of O-rings (not shown). The aspect illustrated in FIGS. 3*a* and 3*b* may comprise a circumferential recess 138 on the outer surfaces of the gap joint components 112, 114. The glands 128 may be located within the recess 138, and the recess 138 may allow for the insertion of an outside diameter seal 124 that may be thicker than the seal 24 of FIGS. 2*a* and 2*b*. The seal 124 may be, but not necessarily be, at least three times the thickness of the thinner seal 24 illustrated in FIGS. 2*a* and 2*b*. The exact thickness may vary from one application to another and/or may be dependent in part on geometry limitations known to the skilled person. The skilled person may select the thickness to reduce a risk of seal puncture. In one aspect, the seal 124 may be in the range of about 0.100-inches to about 0.500-inches thick, and in some aspects, may be about 0.140-inches thick. The downhole end of the seal 124 may abut against a downhole end 140 of the recess 138. The uphole end of the seal 124 may also be retained as described below. The seal 124 may be composed of an electrically insulative material, such as for example, polyether ether ketone (PEEK). Due to the use of a larger PEEK seal 124, the overall electromagnetic gap may be longer, which may improve electromagnetic efficiency.

As may be seen in FIG. 3*b*, a separate shoulder component 132 may be landed on an uphole ledge 136 of the male gap joint component 112, at the first point where electrical isolation stops at the top of the seal 124. Rather than the shoulder 32 that is of unitary construction with the male gap joint component 12 as illustrated in FIGS. 2*a* and 2*b*, this shoulder 132 may be a ring-shaped component that may be replaced when deteriorated and/or may act as a wear indicator. For example, if electrolysis is observed, then the shoulder 132 may be removed and replaced with a new shoulder 132. The replacement may facilitate a simple and cost-effective solution to the problem of electrolysis. The ring-shaped component 132 may be torsionally fixed to the gap joint 300 by geometric features, such as a hexagonal, square or any other keying feature, and/or may be threadably engaged. The ring-shaped component 132 may be held in place by a snap ring, a threaded nut, a press fit, a set screw, or any other functionally comparable arrangement known to the skilled person.

In another aspect, the replaceable shoulder 132 may be composed of a sacrificial material that may be more vulnerable to electron loss (e.g. forming an anode ring), to reduce electron loss from electrolysis at other conductive points on the tool. For example, the shoulder 132 may be composed of copper, beryllium copper, a zinc-based material (or alloy), aluminum alloys, iron, mild steels, etc.

The replaceable shoulder 132 may comprise a downhole edge 134 that extends radially beyond the ledge 136 to provide a surface against which the seal 124 may abut. In this way, the seal 124 may be thicker than the previous seal 24, but may also be retained between two walls (e.g. the recess end 140 and the shoulder edge 134) within the recess 138. The O-rings housed in the glands 128 may be better protected from shear forces as the seal 124 is thicker and better able to hold its cylindrical shape. The seal 124 may hydroform under pressure and press downwardly on the O-rings while closing any potential extrusion gaps. The risk of fluid incursion beneath the seal 124 may be reduced. In addition, the thicker seal 124 may be more resistant to punctures from fluid pressure.

Figure 3C:
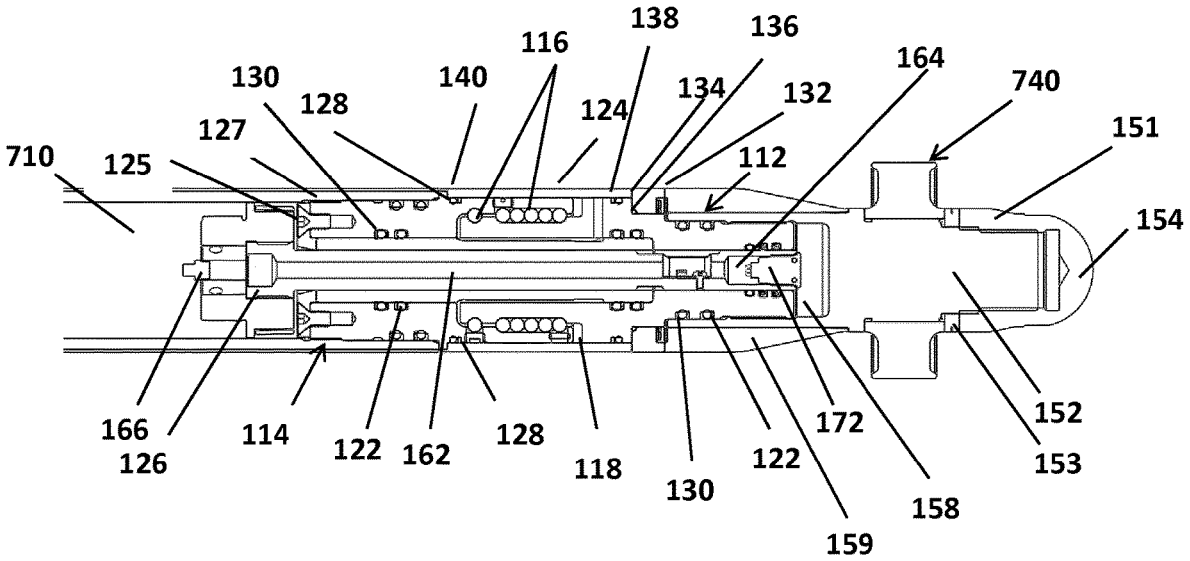
FIG. 3*c* is a side cross-sectional view of a landing spider used in conjunction with the gap joint with the replaceable shoulder on the male mating end.

In the aspect shown in FIG. 3*c*, the replaceable shoulder 132 is shown in use. The gap joint 110 has been coupled at the male mating section 112 to a female end of a landing spider 740. A wall of the end cap female mating section 159 of the landing spider 740 may be configured such that the thickness of the wall decreases near a chamber 158. The chamber 158 may house a wireless transmission device (not shown but described in further detail in U.S. Pub. No. 2016/0194952 assigned to Evolution Engineering Inc., assignee of the present invention, filed on Aug. 12, 2014, the contents of which are herein explicitly incorporated by reference in its entirety). The wall may be thicker at the point where the female mating section 159 connects with the male mating section 112 of the gap joint 110 to provide a solid connection. The end cap female mating section 159 may be typically pressure rated to about 38,000 psi to withstand the downhole pressure environment. An end cap 151 may be typically made of metal to provide structural strength to withstand the harsh environmental conditions downhole and to protect the components in the probe. A metal end cap body 152 may function as a wireless antenna for transmitting signals to a surface computer or other electronic interface.

The landing spider 740 may be fixed into position on the end cap 151 by an acorn nut 154 or some other connector as would be known in the art. The landing spider 740 may have a number of apertures (not shown) and may act to correctly position the tool within a drill collar (not shown) while allowing drilling fluid (mud) to flow through the apertures and between the outer surface of the housing and the inner surface of the drill collar when the tool is positioned downhole. In an aspect, the acorn nut 154 or other connector may be releasably connected to an end cap 151, such that acorn nut 154 or other connector may be removed for repair or replacement of the landing spider 740 which is prone to damage from debris in drilling fluid flowing through the apertures. In an alternative aspect, the acorn nut 154 or other type of connector may be fixedly connected to the end cap 151.

A portion or all of the acorn nut 154 or other connector fixing the landing spider 740 to the end cap 151 may be made of a non-metal material. A metal retaining or locking ring 153 may be provided to fix the landing spider 740 in place on the end cap 151. The metal retaining or locking ring 153 may comprise a wear type indicator and/or a replaceable shoulder as described herein with regard to the other aspects.

At one end of the transmission rod 162 may be an electrical connector 164, and at the other end of the transmission rod 162 may be one or more wires 166. The wires 166 may electrically couple the transmission rod 162 to the battery stack 710. The electrical connector 164 may therefore electrically communicative with the battery stack 710 and a main circuit board (not shown) of the tool.

Figure 4A:
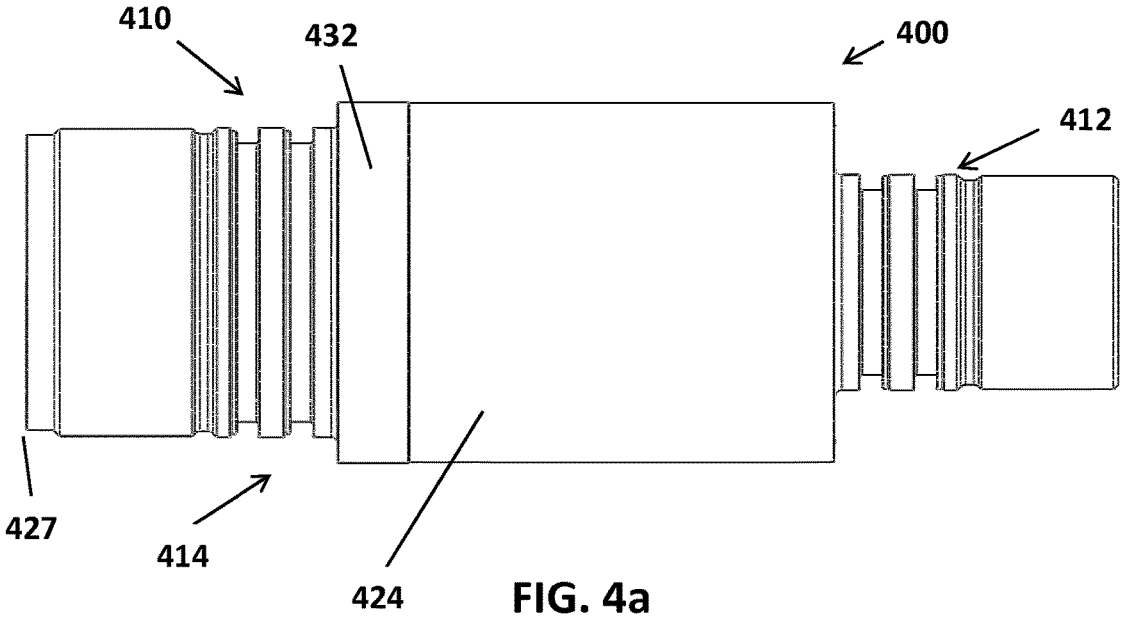
FIG. 4*a* is a side elevation view of a gap joint with both a replaceable shoulder located at a female mating end and an enhanced outside diameter seal.
Figure 4B:
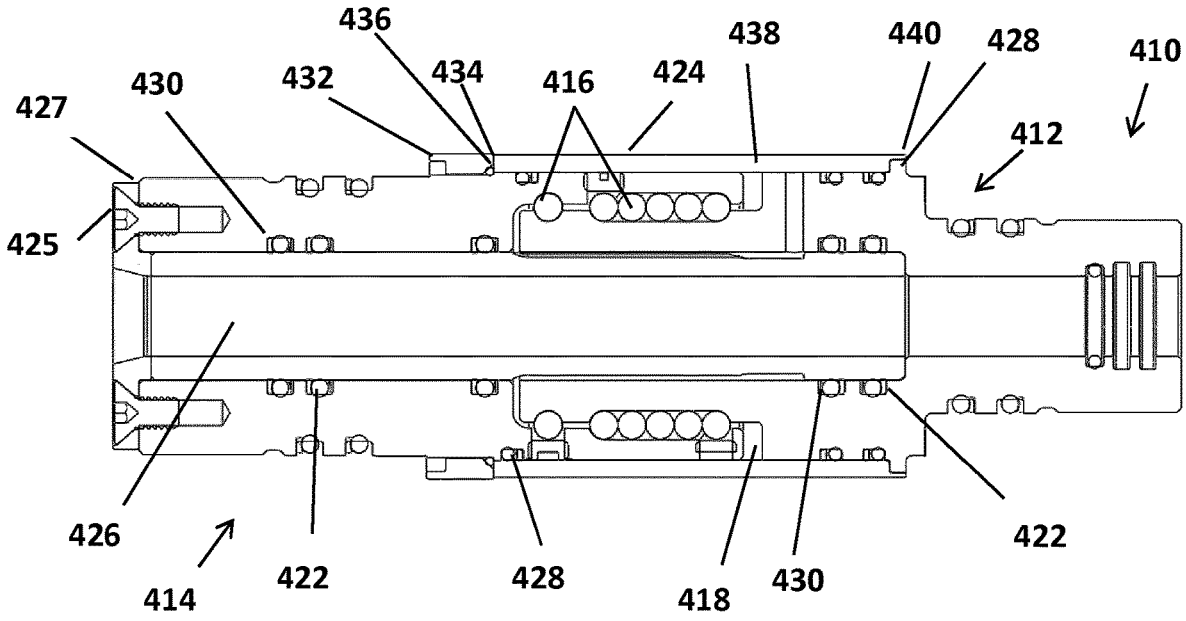
FIG. 4*b* is a side cross-sectional view of the gap joint of FIG. 4*a;*

Turning to FIGS. 4*a* and 4*b*, a gap joint 400 is illustrated having a replaceable shoulder 432 located proximate to a female gap joint component 414. The gap joint 410 may comprise the male gap joint component 412 matingly received in a female gap joint component 414. Electrical isolation of the male and female components 412, 414, and structural support for mechanical loading (e.g. axial forces and/or torsional forces loading), may be achieved in part by electrically isolating balls 416 received within channels, separating the components 412, 414, and an insulative plastic 418 which may be injected into the spaces between the components 412, 414. The strength of the gap joint 410 may be enhanced by the balls 416 and channel arrangement, while the insulating plastic injection 418 may fill the void space to reduce any fluid conductive paths. The ball fill port plugs (not shown) may be solid, which may reduce air and/or injected plastic re-circulation during the injection process, thus resulting in less voids and more consistent and uniform plastic properties.

As in the gap joint 10 illustrated in FIGS. 2*a* and 2*b*, the inner surfaces of the components 412, 414 may be provided with glands 430 for receipt of O-rings 422. Once the O-rings 422 are seated in the glands 430, an inside diameter seal 426 may be inserted, covering the O-rings 422, all the inner surface of the female gap joint component 414 and part of the male gap joint component 412. In this aspect, although not shown in the FIGS. 4*a* and 4*b*, the seal 426 may have a hexagonal external surface where it may be in contact with the injected plastic 418. The inner diameter of the seal may be circular in shape. The flat surfaces of the hexagonal external surface may help prevent rotation of the seal 426 during service life and operation of the gap joint 410 and/or during disassembly of the gap joint from the mating component for servicing, thus extending an effective life of the seal 426. A plurality of screws 425, in this aspect four screws 425 (two of which are shown in sectional view FIG. 4*b*), secure a downhole plate 427 in place against the downhole end of the female gap joint component 414. The downhole plate 427 and screws 425 may help to retain the inside diameter sleeve 426 in position and deter axial movement of the seal 426 caused by pressure variations. This retention may enhance the effective life of the O-ring 422. The ability to remove the screws 425 may also allow for conversion to a dual grounding arrangement, where the screws 425 may be removed and the plate 427 may be replaced with a metal version with a canted coil spring and a gland at the downhole end of the gap joint 410.

The outer surfaces of the gap joint components 412, 414 may be provided with glands 428 for receipt of O-rings (not shown). The aspect illustrated in FIGS. 4*a* and 4*b* may comprise a circumferential recess 438 on the outer surfaces of the gap joint components 412, 414. The glands 428 may be located within the recess 438, and the recess 438 may allow for the insertion of an outside diameter seal 424 that may be thicker than the seal 24 of FIGS. 2*a* and 2*b*. The seal 424 may be, but not necessarily be, at least three times the thickness of the thinner seal 24 illustrated in FIGS. 2*a* and 2*b*. The exact thickness may vary from one application to another and/or may be dependent in part on geometry limitations known to the skilled person. The skilled person may select the thickness to reduce a risk of seal puncture. In one aspect, the seal 424 may be in the range of about 0.100-inches to about 0.500-inches thick, and in some aspects, may be about 0.140-inches thick. The downhole end of the seal 424 may abut against a downhole end 440 of the recess 438. The downhole end of the seal 424 may also be retained as described below. The seal 424 may be composed of an electrically insulative material, such as for example, polyether ether ketone (PEEK). Due to the use of a larger PEEK seal 424, the overall electromagnetic gap may be longer, which may improve electromagnetic efficiency for gaps over about one-half inch in length.

As may be seen in FIG. 4*b*, a separate shoulder component 432 may be landed on an downhole ledge 436 of the female gap joint component 414, at the first point where electrical isolation stops at the bottom of the seal 424. Rather than the shoulder 32 that is of unitary construction with the female gap joint component 14 as illustrated in FIGS. 2*a* and 2*b*, this shoulder 432 may be a ring-shaped component that may be replaced when deteriorated and/or may act as a wear indicator. For example, if electrolysis is observed, then the shoulder 432 may be removed and replaced with a new shoulder 432. The replacement may facilitate a simple and cost-effective solution to the problem of electrolysis. The ring-shaped component may be torsionally fixed to the gap joint by geometric features such as a hexagonal, square or any other keying feature, and/or may be threadably engaged. The ring-shaped component may be held in place by a snap ring, a threaded nut, a press fit, a set screw, or any other functionally comparable arrangement known to the skilled person.

In another aspect, the replaceable shoulder 432 may be composed of a sacrificial material that may be more vulnerable to electron loss (e.g. to form an anode ring), to reduce electron loss from electrolysis at other conductive points on the tool. For example, the shoulder 432 may be composed of copper, beryllium copper, or a zinc-based material.

The replaceable shoulder 432 may comprise a downhole edge 434 that extends radially beyond the ledge 436 to provide a surface against which the seal 424 may abut. In this way, the seal 424 may be thicker than the previous seal 24, but may also be retained between two walls (e.g. the recess end 440 and the shoulder edge 434) within the recess 438. The O-rings housed in the glands 428 may be better protected from shear forces as the seal 424 may be thicker and better able to hold its cylindrical shape. The seal 424 may hydroform under pressure and press downwardly on the O-rings while closing any potential extrusion gaps. The risk of fluid incursion beneath the seal 424 may be reduced. In addition, the thicker seal 424 may be more resistant to punctures from fluid pressure.

Although the aspects of FIGS. 3*a*, 3*b*, and 4*a*, 4*b* are presented independently herein, other aspects may have both the replaceable shoulder 132 on the male gap joint component 112 (e.g. downhole end) and the replaceable shoulder 432 on the female gap joint component 114 (e.g. uphole end).

Figure 5:
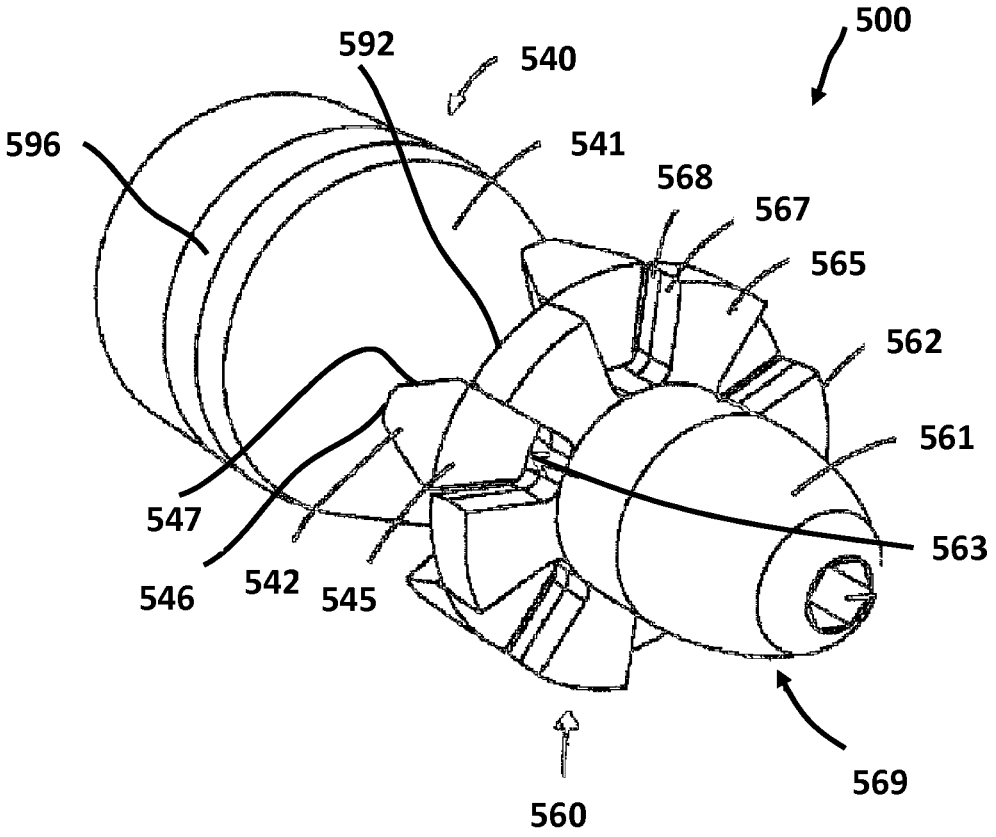
FIG. 5 is a rear perspective view of a fluid pressure pulse generator of a downhole telemetry tool.

Turning now to FIG. 5, a downhole telemetry tool 500 as described in more detail in U.S. Pub. No. 2017/0268331 to Evolution Engineering Inc., assignee of the present invention, the contents of which are herein explicitly incorporated by references in its entirety. A fluid pressure pulse generator may comprise a stator 540 having a longitudinally extending stator body 541 with a central bore therethrough. The stator body 541 may comprise a cylindrical section at the uphole end and a generally frusto-conical section at the downhole end which tapers longitudinally in the downhole direction. The cylindrical section of stator body 541 may be coupled with a pulser assembly housing (not shown). The stator 540 surrounds annular seal (not shown). The external surface of the pulser assembly housing may be flush with the external surface of the cylindrical section of the stator body 541 for smooth flow of mud therealong.

A plurality of radially extending projections 542 may be spaced equidistant around the downhole end of the stator body 541. Each stator projection 542 may be tapered and narrower at a proximal end attached to the stator body 541 than at a distal end. The stator projections 542 may have a radial profile with an uphole end or face 546 and a downhole end or face 545, with two opposed side faces 547 extending therebetween. A section of the radial profile of each stator projection 542 is tapered towards the uphole end or face 546 such that the uphole end or face 546 is narrower than the downhole end or face 545. The stator projections 542 may have a rounded uphole end 546 and most of the stator projection 542 tapers towards the rounded uphole end 546.

Mud flowing along the external surface of the stator body 541 may contact the uphole end or face 546 of the stator projections 542 and may flow through stator flow channels along the sides of the stator defined by the side faces 547 of adjacently positioned stator projections 542. The stator flow channels may be curved or rounded at their proximal end closest to the stator body 541. The stator projections 542 and thus the stator flow channels defined therebetween may be any shape and dimensioned to direct flow of mud through the stator flow channels 543.

The rotor 560 may comprise a generally cylindrical rotor body with a central bore therethrough and a plurality of radially extending projections 562. The rotor body 569 may be received in the bore of the stator body 541. A downhole shaft of the driveshaft (not shown) may be received in uphole end of the bore of the rotor body 569 and a coupling key (not shown) may extend through the driveshaft and may be received in a coupling key receptacle (not shown) at the uphole end of the rotor body 569 to couple the driveshaft with the rotor body. A rotor cap may comprise a cap body 561 and a cap shaft (not shown) may be positioned at the downhole end of the fluid pressure pulse generator. The cap shaft may extend through the downhole end of the bore of the rotor body 569 and threads onto the downhole shaft of the driveshaft to lock (torque) the rotor 560 to the driveshaft.

The radially extending rotor projections 562 may be spaced equidistant around the downhole end of the rotor body 569 and may be axially positioned downhole relative to the stator projections 542. The rotor projections 562 may rotate in and out of fluid communication with the stator flow channels to generate pressure pulses. Each rotor projection 562 may have a radial profile including an uphole end or face and a downhole end or face 565, with two opposed side faces 567 and an end face 592 extending between the uphole end or face and the downhole end or face 565. The rotor projections 562 may taper from the end face 592 towards the rotor body 569 so that the rotor projections 562 may be narrower at the point that joins the rotor body 569 than at the end face 592. Each side face 567 may have a bevelled or chamfered uphole edge 568 which may be angled inwards towards the uphole face such that an uphole section of the radial profile of each of the rotor projections 562 tapers in an uphole direction towards the uphole face.

To generate fluid pressure pulses a controller (not shown) in an electronics subassembly (not shown) may send motor control signals to a motor and a gearbox subassembly (not shown) to rotate the driveshaft and rotor 560 in a controlled pattern.

Located proximate to (e.g. near or at) the uphole end of the downhole telemetry tool 500 may be a wear part indicator 596. The wear part indicator 596 may comprise a replaceable ring constructed of a material similar to that of the replaceable shoulder 132, 432 described above with reference to FIGS. 3*a*, 3*b*, 4*a*, and 4*b*. When the wear part indicator 596 (also known as a wear type indicator) is subjected to a downhole environment, the wear part indicator 596 may exhibit a type of wear, such as wash, pitting, electrolysis, corrosion, etc. capable of being analyzed. The type of wear may indicate local flow conditions, such as turbulence, flow rate, etc.

The wear type indicator 596 may be configured so that it may be placed in many different circumferential recesses located along a drill string. In some aspects, the recesses may have a depth equal to the thickness of the wear part indicator 596 such that when the wear type indicator 596 is placed in the recess, the outer surface of the wear type indicator 596 may flush with the outer surface of the drill string. In other aspects, the recesses may have a depth less than the thickness of the wear type indicator 596 such that the wear type indicator 596 may protrude from the recess. The wear type indicator 596 may then be placed at these different recesses and the wear may be analyzed to determine how tool designs affect wear patterns. The design changes may assist in reducing local turbulence in areas where there may be increased wear or damage. The wear indicator 596 may be analyzed to determine if the new design may introduce additional wear when compared to the prior design. For example, if a new pulser assembly is introduced to provide improved pressure pulses, the wear indicators 596 may determine if the geometry of the new pulser assembly introduced significant or unforeseen wear. However, the wear indicators would not determine if the pressure pulses from the new assembly are improved or not. If the wear type indicator 596 is not necessary at a location for a particular test, the wear type indicator 596 may be replaced with a filler or placeholder ring constructed of a material that has similar properties to the material surrounding the recess to limit the effect of the filler ring on the tool 500.

Figure 6A:
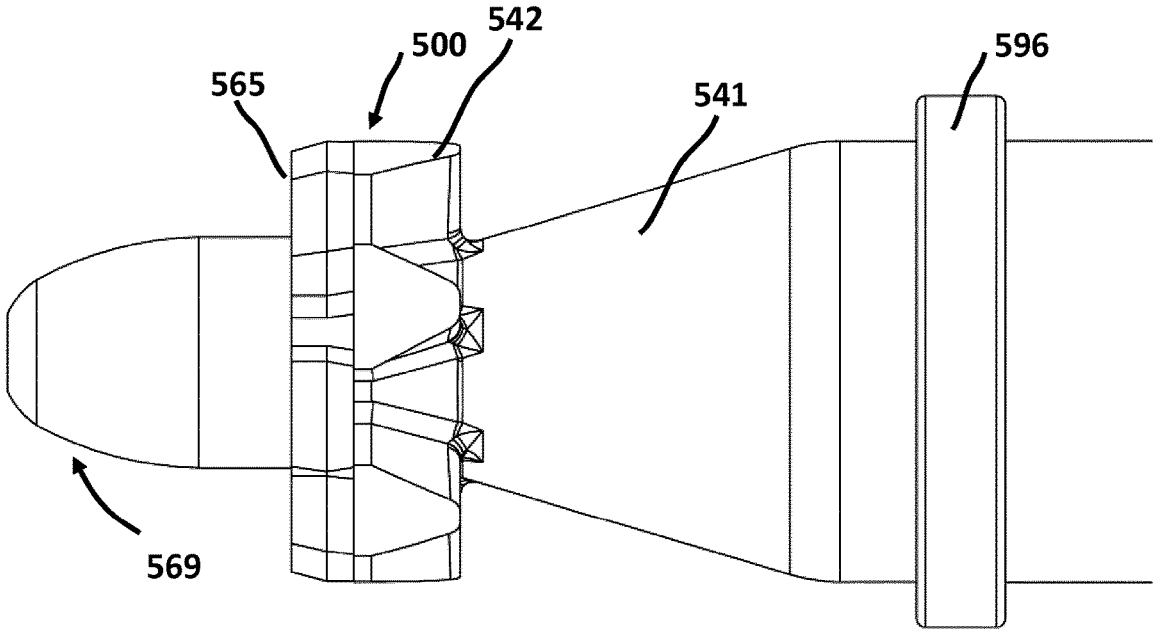
FIG. 6*a* is a side view of the fluid pressure pulse generator of the downhole telemetry tool according to one aspect.
Figure 6B:
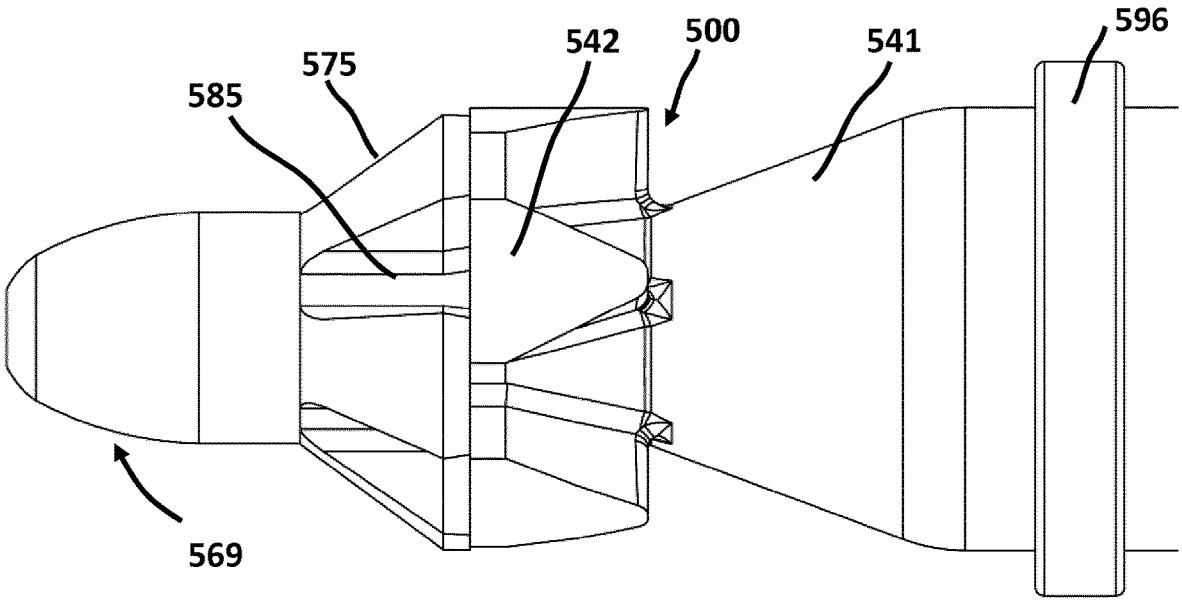
FIG. 6*b* is a side view of the fluid pressure pulse generator of the downhole telemetry tool according to another aspect.

In some aspects, the wear type indicator 596 may enable analysis of a design change in the tool 500, such as depicted in FIGS. 6*a* and 6*b*. The tool 500 depicted in FIG. 6*a* comprises a two-position tool 500 having a generally flat downhole end 565 and relatively shorter stator projections 542. The tool 500 presented in FIG. 6*b* comprises a plurality of tapers 575 interleaved with channels 585 as well as relatively longer and wider stator projections 542. The use of the wear indicator 596 at the same location on both tools may permit a comparison of the wear on the wear indicator 596 of both tools 500 to determine an impact of the design change with respect to the flow conditions. In some aspects, the design change may comprise different steps, tapers, and/or grooves in the tool 500. Although disclosed as the comparison of two tools 500, other aspects may compare any number of wear indicators 596 on a plurality of tools 500 in order to determine the impact of the design changes between each of the plurality of tools 500.

In some aspects, the wear type indicator 596 may be used as a tool service indicator. For example, if the wear type indicator 596 has been reduced to a particular outer diameter, then maintenance may be required on the tool 500. This wear indicator 596 may consider drilling conditions rather than solely using a set number of hours. In other aspects, the wear type indicator 596 may change colour to indicate maintenance may be required on the tool 500.

Although FIGS. 5, 6*a*, and 6*b* demonstrate the wear part indicator 596 at a particular location on the downhole telemetry tool 500, other aspects may have one or more wear part indicators 596 located at different locations along the tool 500, such as for example, at one or more joints, sleeves on one or more joints, a stepped diameter addition to the tool, etc. In other aspects, one or more wear part indicators 596 may be located at various points along the drilling string such as between different collars, near a mud motor, and/or near a drill bit.

Figure 7A:
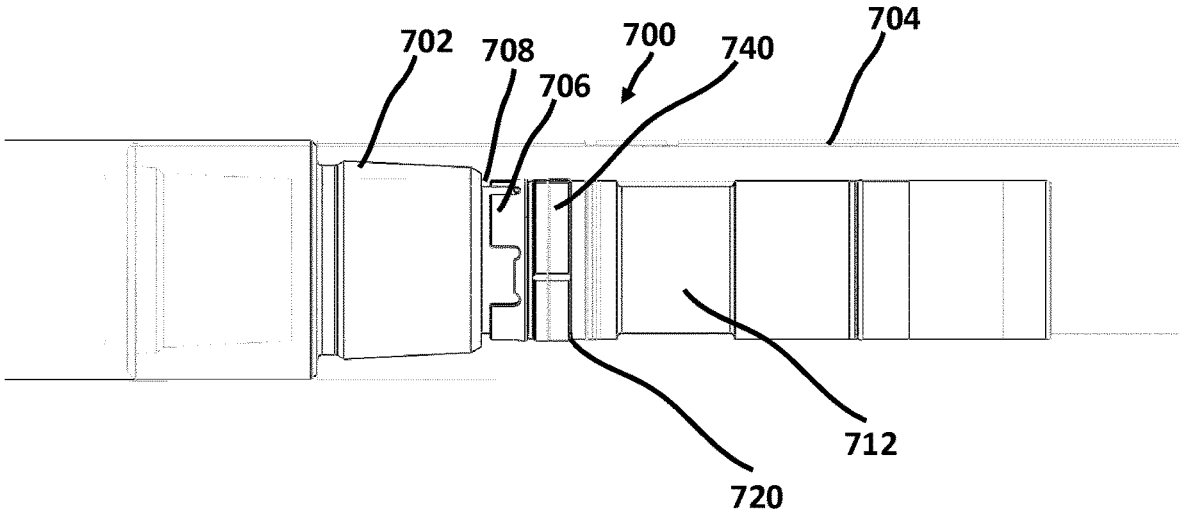
FIG. 7*a* is a side view of a portion of a bottom hole assembly.
Figure 7B:
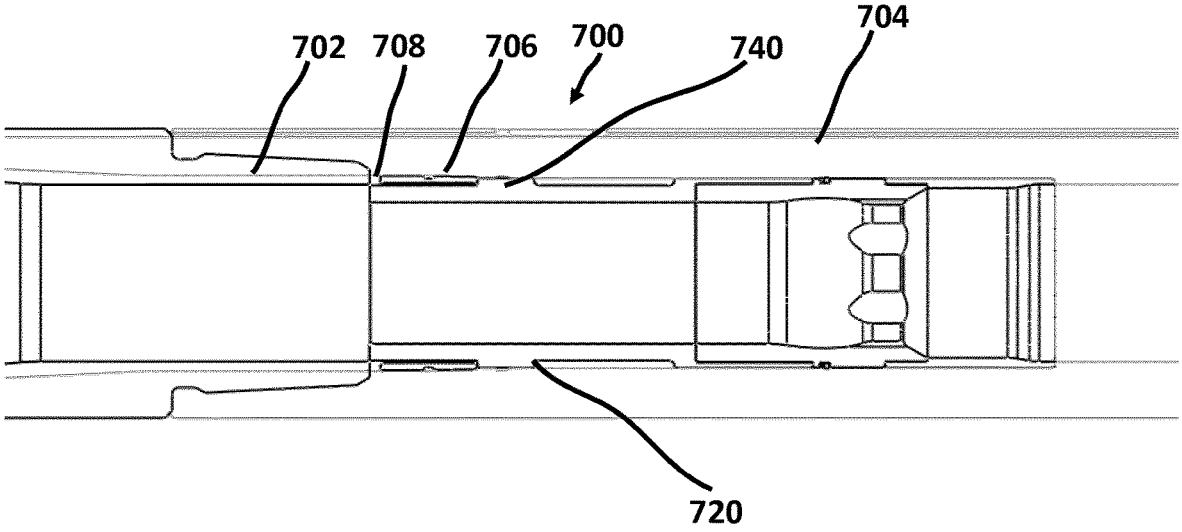
FIG. 7*b* is a side cross-sectional view of the portion of the bottom hole assembly of FIG. 7*a*.
Figure 7C:
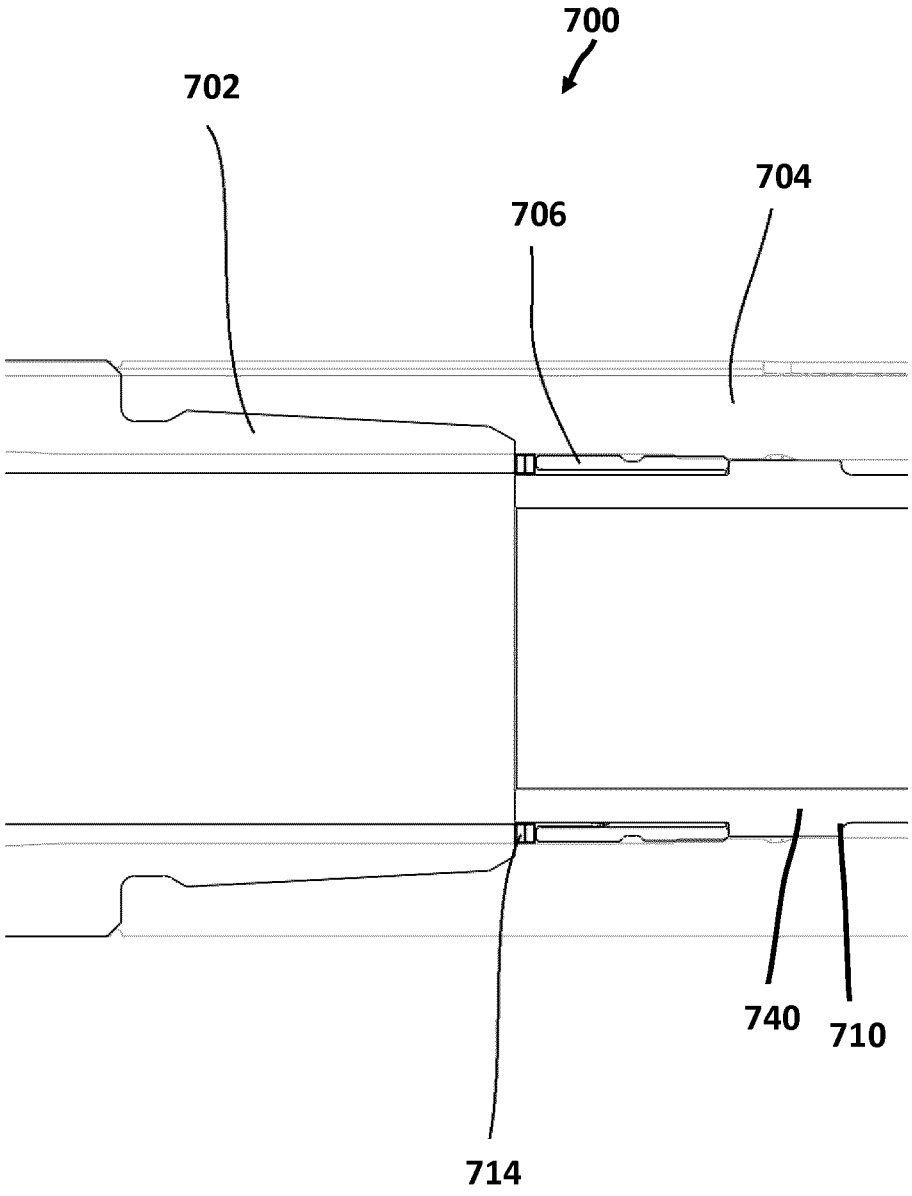
FIG. 7*c* is an enlarged side cross-sectional view of the castle nut with one or more corrosion ring coupons.

Turning now to FIGS. 7*a* to 7*c*, a portion of an internal bottom hole assembly (BHA) 700 is illustrated. A pin of a centralizer collar 702 may be rotatably coupled to a grounding collar 704. The pin 702 may be threaded into corresponding threads of the grounding collar 704. An outer diameter of a castle nut 706 may be threaded into a corresponding thread in a tapered part of the grounding collar 704. A bore 712 may store the telemetry probe that may be coupled to the landing spider 740 that may hold the probe concentric to the bore 712. The castle nut 706 may lock the spider 740 axially in place against a shoulder 720 in the collar. The castle nut 706 may be threaded forward until it contacts the spider 740. The castle nut 706 may compress the spider 740 against the shoulder 720, which in turn locks the entire telemetry probe axially.

A gap or void 708 may be present between the castle nut 706 and the pin of the centralizer collar 702. During use, the castle nut 706 may back-off from the landing spider 740 and into the void 708 due to intense vibrations that may occur downhole. The castle nut 706 locks the spider axially, which in turn locks the telemetry probe axially. If the castle nut 706 backs off, the telemetry probe may move resulting in many problems, such as a significant vibration of the entire probe, damaging electrical components stored therein, etc.

In the aspect shown in FIG. 7*c*, one or more ring spacers 714 may be placed inside the grounding collar 704 adjacent to the castle nut 706 before the pin of the centralizer collar 702 is threaded into the grounding collar 704. The ring spacers 714 may substantially fill the void 708 between the pin 702 and the castle nut 706 thereby preventing the castle nut 706 from backing off the landing spider 740. A portion of or the entire ring spacer 714 may comprise a corrosion coupon that may indicate an acidity or other harshness of the drilling fluid. The corrosion coupon may be evaluated periodically to determine a maintenance schedule (e.g. damage beyond repair) for the bottom hole assembly in harsh hole environments. The ring spacer 714 may provide a dual benefit of preventing backing off of the castle nut 706 and evidence of harsh hole conditions.

Although the term "shoulder" may be used throughout, the shoulder may be referred to as a ring, an anode ring, a locking ring, an annular band, and/or an annular cylinder. Although the term "ring" may be used throughout, there may be instances where the ring may not be a complete ring but may be a crescent, or a ring missing a portion thereof.

As will be clear from the foregoing, aspects of the present invention may provide a number of desirable advantages over the prior art. For example, the ability to replace the shoulder portion subject to electrolysis may enhance the useful life of the asset, and may make the asset much more readily serviceable. Also, the use of the enhanced outside diameter seal arrangement not only better prevents seal failure at the outer surface but may also increase the effective electrical gap of the joint. In addition, there may be an increased wear limit on the seal before replacement may be necessary.

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific aspects of methods and apparatus have been described herein for purposes of illustration. These are only examples. The technology provided herein may be applied to contexts other than the exemplary contexts described above. Many alterations, modifications, additions, omissions, and permutations may be possible within the practice of this invention. This invention includes variations on described embodiments that may be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary aspects set forth in the foregoing, but should be given the broadest interpretation consistent with the specification as a whole.

The invention claimed is:

1. A gap joint for use in electromagnetic telemetry applications, the gap joint comprising:

a female gap joint component;

a male gap joint component configured for at least partial insertion into the female gap joint component;

an electrically isolative material disposed between the female gap joint component and the male gap joint component;

a circumferential recess in an outer surface of the male gap joint component and in an outer surface of the female gap joint component; and a seal member configured for receipt in the circumferential recess so as to overlie the outer surface of the male gap joint component and the outer surface of the female gap joint component.

2. The gap joint of claim 1 further comprising at least one O-ring seal disposed in the circumferential recess and overlain by the seal member.

3. The gap joint of claim 1 wherein the seal member comprises an uphole edge to abut an uphole inner surface of the circumferential recess.

4. The gap joint of claim 3 wherein the seal member further comprises a downhole edge to abut a downhole inner surface of the circumferential recess.

5. The gap joint of claim 1 wherein the seal member is in the range of 0.100 to 0.500 inches thick.

6. The gap joint of claim 1, further comprising:

a replaceable member coupled to at least a portion of the gap joint, wherein the replaceable member comprises at least a portion thereof that exhibits during use a degradation by electrolysis at a higher rate in comparison to the female gap joint component end or the male gap joint component.

7. The gap joint of claim 6, wherein the replaceable member is located on the female gap joint component.

8. The gap joint of claim 6, wherein the replaceable member is located on the male gap joint component.

9. The gap joint of claim 8, wherein the replaceable member forms a shoulder where the seal member abuts.

10. The gap joint of claim 6, wherein a material of the replaceable member is selected from the group consisting of copper, beryllium copper, a zinc-based material, aluminum alloys, iron, and mild steel.

11. A gap joint for use in electromagnetic telemetry applications, the gap joint comprising:

a female gap joint component;

a male gap joint component comprising opposed first and second ends, the first end configured for at least partial insertion into the female gap joint component;

an electrically isolative material disposed between the female gap joint component and the male gap joint component;

a replaceable member configured for connection to the second end of the male gap joint component;

a circumferential recess in an outer surface of the male gap joint component and in an outer surface of the female gap joint component; and a seal member configured for receipt in the circumferential recess so as to overlie the outer surface of the male gap joint component and the outer surface of the female gap joint component.

12. The gap joint of claim 11 wherein the replaceable member comprises a shoulder, and an edge of the seal member abuts the shoulder.

13. The gap joint of claim 12 wherein the seal member abuts both the shoulder of the replaceable member and an inner surface of the circumferential recess.

14. The gap joint of claim 11 wherein the replaceable member is composed of a material that loses electrons during use preferentially to other parts of the gap joint axially displaced from the replaceable member.

15. The gap joint of claim 14 wherein a material of the replaceable member is selected from the group consisting of copper, beryllium copper, and a zinc-based material.

16. The gap joint of claim 11 wherein the seal member is composed of polyether ether ketone.

* * * * *